US007506691B2

(12) United States Patent
Vilela et al.

(10) Patent No.: US 7,506,691 B2
(45) Date of Patent: Mar. 24, 2009

(54) UPPER-COMPLETION SINGLE TRIP SYSTEM WITH HYDRAULIC INTERNAL SEAL RECEPTACLE ASSEMBLY

(75) Inventors: Alvaro Jose Vilela, Rio de Janerio (BR); Simon Danborg, Lafayette, LA (US); Francisco Pineda, Houston, TX (US); Charles Kibbe, New Iberia, LA (US)

(73) Assignee: BJ Services Company, Houston, TX (US)

( * ) Notice: Subject to any disclaimer, the term of this patent is extended or adjusted under 35 U.S.C. 154(b) by 225 days.

(21) Appl. No.: 11/343,224

(22) Filed: Jan. 30, 2006

(65) Prior Publication Data

US 2006/0219413 A1 Oct. 5, 2006

Related U.S. Application Data

(60) Provisional application No. 60/648,913, filed on Jan. 31, 2005.

(51) Int. Cl.
*E21B 23/00* (2006.01)

(52) U.S. Cl. ..... 166/381; 166/125; 166/242.6

(58) Field of Classification Search ..... 166/381, 166/242.6, 98, 99, 125
See application file for complete search history.

(56) References Cited

U.S. PATENT DOCUMENTS

| | | | | |
|---|---|---|---|---|
| 3,381,752 | A * | 5/1968 | Elliston | 166/120 |
| 6,056,055 | A * | 5/2000 | Falconer et al. | 166/297 |
| 7,331,388 | B2 | 2/2008 | Vilela et al. | 166/278 |
| 2003/0066655 | A1 * | 4/2003 | Cook et al. | 166/380 |

* cited by examiner

*Primary Examiner*—David J. Bagnell
*Assistant Examiner*—Sean D Andrish
(74) *Attorney, Agent, or Firm*—Howrey LLP

(57) ABSTRACT

An upper-completion single trip system is described which includes a hydraulic internal seal receptacle assemble. The HISR assembly includes an overshot assembly selectively connected to a mandrel assembly. Once fully actuated, relative axial motion therebetween is allowed, which provides a spacer apparatus for the tubing above and below the HISR assembly. A shearable anchor latch as well as an indexing mule shoe are also provided in the HISR system, which allow multiple completion steps to be performed in a single trip. The HISR system is particularly well-suited for installation of permanent downhole gauges or intelligent systems—installations where rotation of pipe is prohibited. The system is also particularly well-suited for submersible pumps. A method of performing multiple completion activities in a single trip is also described.

21 Claims, 5 Drawing Sheets

210
212
213
3D
260
3C 271
3E

271

270

213
212
210

UPPER-COMPLETION SINGLE TRIP SYSTEM WITH HYDRAULIC INTERNAL SEAL RECEPTACLE ASSEMBLY

CROSS-REFERENCE TO RELATED APPLICATIONS

This application claims the benefit of U.S. Provisional Application No. 60/648,913 filed Jan. 31, 2005, hereby incorporated by reference in its entirety, entitled "Upper-Completion Single Trip System with Hydraulic Internal Seal Receptacle Assembly," by Vilela et al.

BACKGROUND OF THE INVENTION

1. Field of the Invention

The present invention relates to the drilling and completion of well bores in the field of oil and gas recovery. More particularly, this invention relates to an apparatus adapted to provide a spacing mechanism between relatively-long strings of tubular string (e.g., a production tubing string, and the like) extending within a well bore. The apparatus may be used in an Upper-completion Single Trip ("UST") system, and may include a Hydraulic Internal Seal Receptacle ("HISR") assembly (also known as a "One Trip Stinger Assembly") as a component thereof.

2. Description of the Related Art

In the oil and gas industry, production string is run thousands of feet into the earth. Well bores are typically drilled by rotating a drill string comprising a plurality of drill pipe segments serially connected to a bottom hole assembly and a drill bit thereby creating the well bore. As the well bore is drilled, tubular casing may be placed in the well bore to protect the well bore. The casing may then be cemented as desired. Progressively smaller diameter casing may be used as the well bore is drilled deeper until a hydrocarbon-bearing formation is penetrated. Once the production casing is in place, production pipe or tubing may also be run within the casing string in the well bore. Production tubing strings may typically be thousands of feet in length, in order to place the lower end of the tubing adjacent the hydrocarbon-bearing subterranean formation. Such systems may be utilized on land or offshore.

The temperature of the long production strings is adapted to change over time. For instance, during production, the temperature of the strings increases. This increase in temperature leads to concomitant increase in the length of the string. If the string is anchored on each end, then the increased length causes compressive stresses to accumulate on within the tubing string.

Similarly, if the tubing string is cooled, the overall length of the string is reduced. Thus, the string is prone to be susceptible to tensile stresses. Due to the overall length of the tubing string, changes in temperature e.g. may impart significant forces thereupon which are detrimental to the operation of the tubing string. For example, when being run downhole, the relatively cool temperature of the brine cools the tubing string such that the metal tubing string contracts. When in production the hydrocarbons passing through the tubing string forces the tubing string to expand its overall length. When operated in a deviated or horizontal well, these forces are exasperated.

To reduce this associated stress, it is desirable to provide a spacing mechanism. The mechanism should be adapted to be placed in the string and accommodate the changing length of the string, thus reducing the associated stresses. Thus, it is desirable to provide a spacing function in the tubing string to act to compensate for the expansion and contraction of these relatively long tubing strings to reduce the associated stresses therein.

It is known to provide spacers in the production string during completion. However, present assemblies are known to prematurely or accidentally actuate, causing difficulties while running downhole. For example, if the spacer tool contacts an unintended obstruction downhole, the tool may accidentally, prematurely release or actuate, thus hampering the running in of the tool.

In some prior art methods, a spacing device is provided which is assembled utilizing shear pins. To activate the spacing device, the shear pins are sheared. However, with such systems, the spacing device may be accidentally actuated by the tool contacted unanticipated debris or an obstruction downhole. Thus, the spacing device begins to function long before desired.

Further, during the completion of the well, it is needed to perform additional functions downhole, such as aligning and running the production tubing in the packer downhole, and locking the production string into a packer downhole.

Presently, it is known to perform each of these functions in separate trips into the wellbore. Each trip down the wellbore adds significant cost and time to the completion project. Thus, it is desirable to perform each of these three functions in a single trip to reduce the overall cost of the project, reduce the number of components utilized in the job, and reduce the number of components falling downhole (e.g. clamps).

Also, desirable to be able to rotate the entire spacing assembly, should any downhole component become lodged and rotation is necessary to attempt to dislodge the assembly.

In other situations, it is desirable to provide a latching mechanism and a mule shoe assembly, which does not require rotation of any downhole components to operate. For instance, when performing the installation of permanent downhole gauges or intelligent-type system, rotation is not possible, as these systems typically include the use of hydraulic lines, electric line, or fiber optics.

Thus, there is a need for an apparatus that provides a spacing function along a tubing string wherein the apparatus is not prone to premature or accidental activation. Preferably, the system is capable of performing the functions of providing a spacer, aligning and running the production tubing in a packer, and locking the production string into the packer in a single trip downhole, thus significantly saving time and cost of the completion process. It is also desirable that the system also provide means for selectively breaking the string such that components above the system may be removed or repaired; once the repair is completed, the system should be able to rejoin the string.

Embodiments of the present invention are directed at overcoming, or reducing and minimizing the effects of, any shortcomings associated with the prior art.

SUMMARY OF THE INVENTION

In some embodiments, the invention relates to an assembly for providing a spacing function for production tubing, etc. The invention is also related to providing means for selectively engaging and disengaging the tubing string. The HISR assembly is adapted to maintain its original length during run in, and, when desired, the HISR may be hydraulically actuated to such that relative movement between the crossover assembly 200 and the mandrel assembly 300 is allowed, thus providing the spacing function to relieve stress on the production tubing, both above and below the assembly 100. The load pins 400, being relatively robust, and the operation thereof, act to prevent the premature actuation of the HISR assembly 100 caused by a mechanical force (e.g. pushing on or pulling the HISR assembly 100).

The invention also relates to a system including the HISR assembly, to perform multiple completion operations in a single trip, in some embodiments. The disclosed system may be used in deepwater wells with wet-type Christmas trees for upper completion installations where rotation of the assembly is not possible, especially during installation of permanent downhole gauges or intelligent-type completions. Such installations typically utilize electric, hydraulic, or fiber optic lines, thus precluding rotation of the production string. The system described herein may be composed of an indexing mule-shoe, a shearable type anchor latch, and a Hydraulic Internal Seal Receptacle ("HISR") for space-out purposes during the landing of the tubing hanger. The HISR assembly is run connected to the shearably anchor latch assembly, seals, and an indexing mule shoe. The automatic indexing mule shoe needs no rotation. Above the system is production or injection tubing, where the permanent downhole gauges or the intelligent type completion is assembled and run to depth. The shearable anchor latch is landed into the production packer. Tubing pressure is then applied to release the Internal Seal Receptacle providing enough travel to space-out the tubing hanger. A secondary mechanical release method is available as well, by using a slick line, wire line, or coiled tubing.

In some embodiments, the HISR system is not only composed of the HISR assembly but also includes a shearable anchor latch, seals, and the indexing mule-shoe. This allows the HISR system to be used in deepwater completions that requires PDG (Permanent downhole gauges) or Intelligent Completions, where the upper completion may be performed in one-trip without requiring rotation of any kind. Thus, the apparatus may be used to eliminate the need multiple trips downhole for completion purposes.

Also disclosed is a method of providing a spacing mechanism, as well as a method of performing multiple completion activities in a single step.

Figure 1:
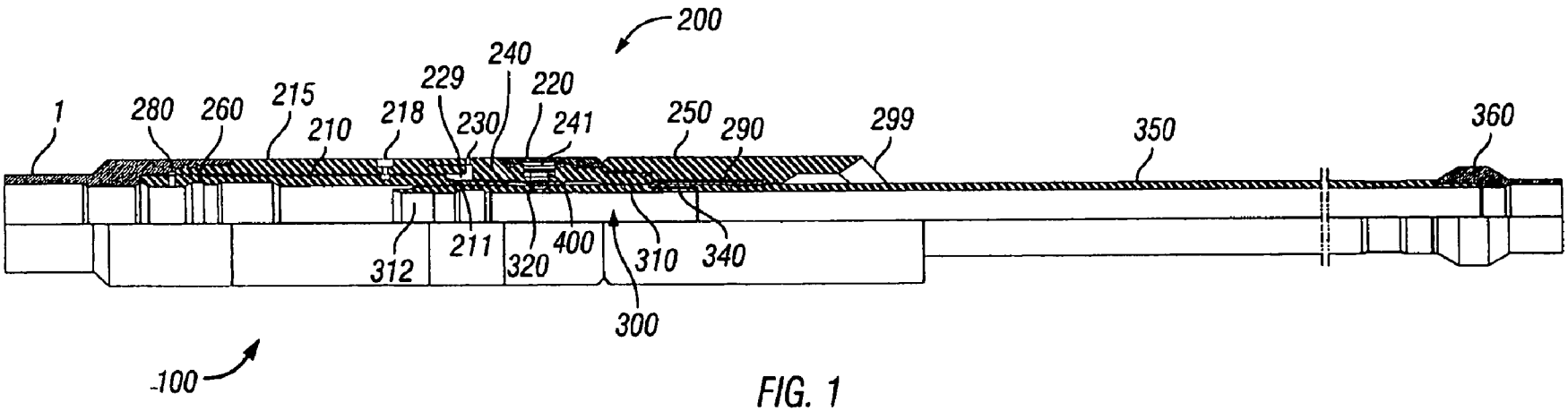
FIG. 1 shows an embodiment of an embodiment of a Hydraulic Internal Seal Receptacle ("HISR") assembly 100 or "One Trip Stinger Assembly" in isolation.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the oil and gas recovery operation and in the completion of well bores. In the interest of clarity, not all features of an actual implementation are described in this specification. It will of course be appreciated that in the development of any such actual embodiment, numerous implementation-specific decisions must be made to achieve the developers' specific goals, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Embodiments of the invention will now be described with reference to the accompanying figures. Similar reference designators will be used to refer to corresponding elements in the different figures of the drawings.

Referring to FIG. 1, the HISR assembly 100 may be connected extending from a tubing hanger below a Christmas tree at surface via the piping or working/tubing string 1, as would be realized by one of ordinary skill in the art.

In some embodiments, the HISR assembly 100 generally may be comprised an overshot assembly 200 (or receptacle) functionally associated with a mandrel assembly 300. Also generally, the HISR assembly 100 may be adapted to be run downhole in an initial configuration—wherein the tool in its initial, unreleased, set position having an initial length L1. All components of the HISR assembly 100 are fixed in the initial run in configuration. In the initial configuration, relative axial movement between the overshot assembly 200 and the mandrel assembly 300 is precluded. The HISR assembly 100 may then be selectively activated as described herein, such that relative axial movement between the overshot assembly 200 and the mandrel assembly 300 is selectively allowed. Thus, once fully activated, the overall length of the HISR assembly 100 is less than its initial length L1 and may vary as , described below.

The mandrel assembly 300 of the HISR assembly 100 may include a nipple 310 and at least one polished stinger 350 in this embodiment, described hereinafter.

The overshot assembly 200 is connectable to the tubing or work string 1. The overshot assembly 200 may include a piston 210. A lock ring 280 circumscribes an upper end of the piston 210, as shown in FIG. 1, and as described hereinafter. The piston 210 may include a shoulder 260 for mechanical activation of the HISR assembly also as described hereinafter. The piston 210 of the overshot assembly 200 may be selectively connectable to an upper outer sleeve 215 of the overshot assembly 200 by shear pins 218. The shear pins 218 may be adapted to shear at a given predetermined force, either by varying the number of pins or the strength of each pin, etc. When the HISR assembly 100 is in its initial run-in configuration (i.e. before the shear pins 218 are sheared), a gap 229 exists between an inner shoulder 211 of piston 210 and the pin housing 240 of the overshot assembly 200. A fluid communication port 230 is provided through the pin housing 240. The overshot assembly 200 may also include a pin lid or seal cap 220 adapted to cover a void 241 within the pin housing 240 to prevent the load pin 400 from becoming disassociated with the HISR assembly 100 and seal out the annulus pressure to prevent fluid communication between the annulus and the ID. The overshot assembly 200 may also include a lower overshot sleeve 250, which may be sealingly connectable to the pin housing 240. The lower overshot sleeve 250 may house internal molded seals, which may be invented molded seals, as described hereinafter.

Figures 3A, 3B, 3C, 3D, 3E:
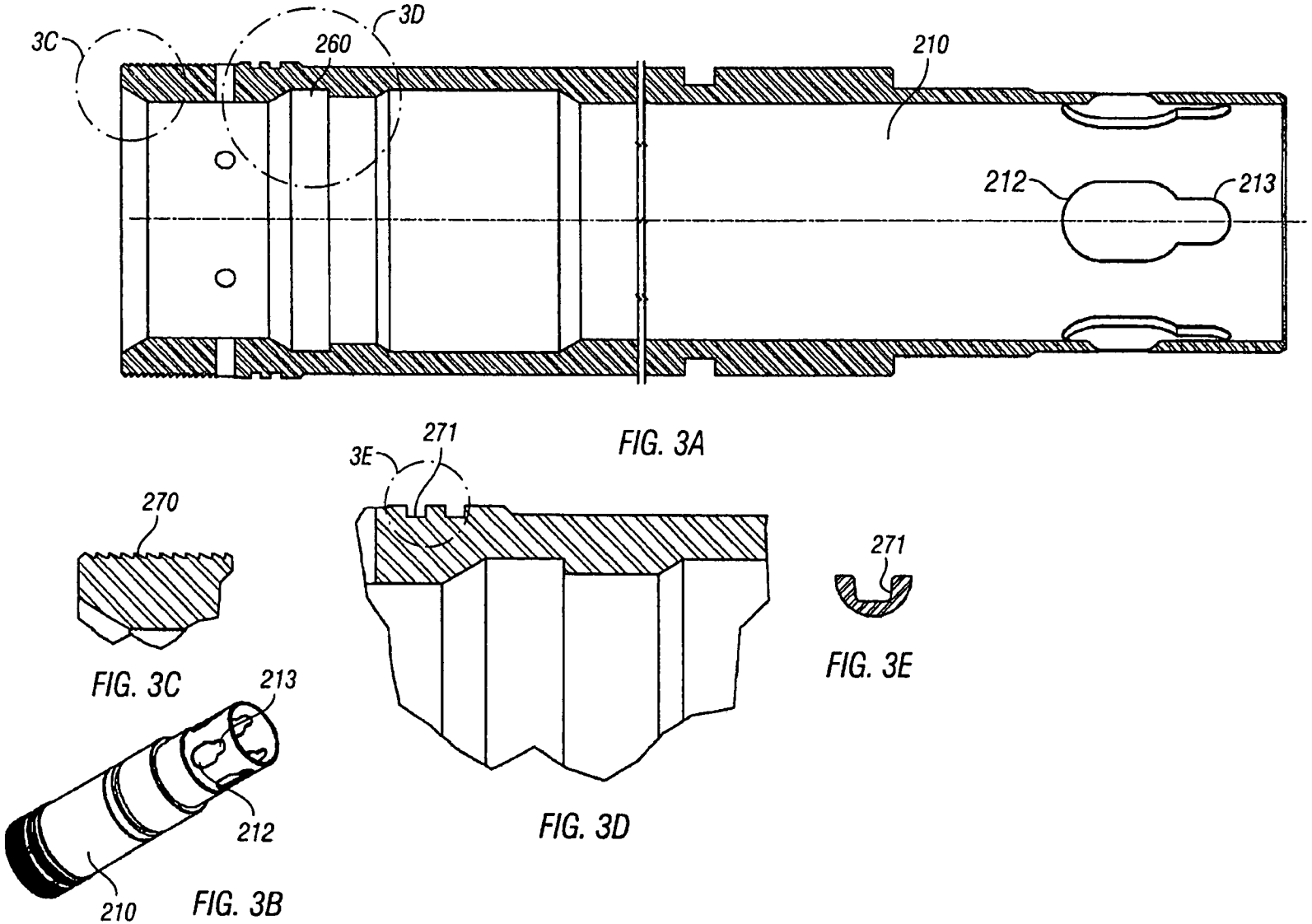
FIGS. 3A-E show a piston of an overshot assembly of one embodiment of the present invention in isolation, as well as detailing various aspects thereof.

Various aspects of an embodiment of the piston 210 of the overshot assembly 200 are shown in FIGS. 3A-E. FIG. 3A shows a cross section of the piston 210. A plurality of openings 212 are shown on the lower end of the piston 210. The openings 212 may comprise any shape, provided the shape is adapted to function to selectively secure the load pins 400 in an initial, innermost position as described hereinafter. As shown, the openings 212 may comprise a generally oval (shower-curtain hanger shape) having a recess 213 on a lower end. That is, the opening 212 includes a recessed opening 213 on one end. The plurality of openings 212 (five as shown) may be evenly dispersed on the lower end of the piston 210 in this embodiment, The upper end of piston 210 may include a plurality of wickers 270 adapted to engage the lock ring 280. The lock ring 280 may comprise a plurality of wickers on an inner diameter adapted to selectively mate with the wickers 270 on the upper end of the piston 210. That is, as the piston 210 moves downwardly, lock ring 270 (and the wickers thereon) act to prevent the piston 210 from moving upwardly to its original, uppermost position. Also, a shoulder 260 may be provided on the ID (internal or inner diameter) of the piston 210 for backup mechanical activation. Finally, one or more o-ring grooves 271 may be provided to accommodate an o-ring to provided appropriate sealing between various dynamic components.

The overshot assembly 200 is adapted to be selectively connected to the mandrel assembly 300. In the embodiment shown in FIG. 1, the overshot assembly 200 is connected to the mandrel assembly 300 via load pins 400 serving as connecting means. Load pins 400 may be selected to support a predetermined weight and are not generally easily sheared. For example, the load pins 400 may be selected such that the load pins 400 may withstand 100,000 pounds force. Any other attachment means known to one of ordinary skill in the art could be utilized in this configuration. As shown in FIG. 1, the load pins 400 are adapted to engage a groove within the mandrel.

Figure 2A:
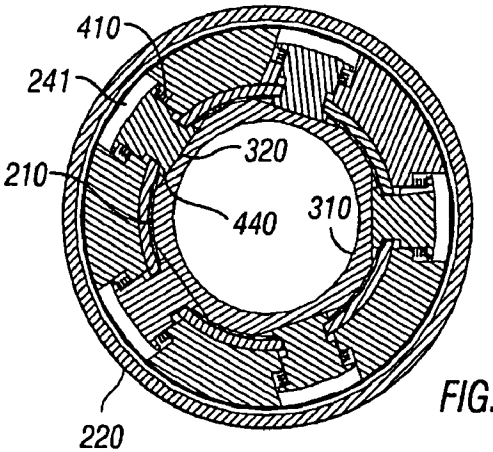
FIGS. 2A-2C show various components of the HISR assembly in isolation or cross-section, as described more fully herein.
Figure 2C:
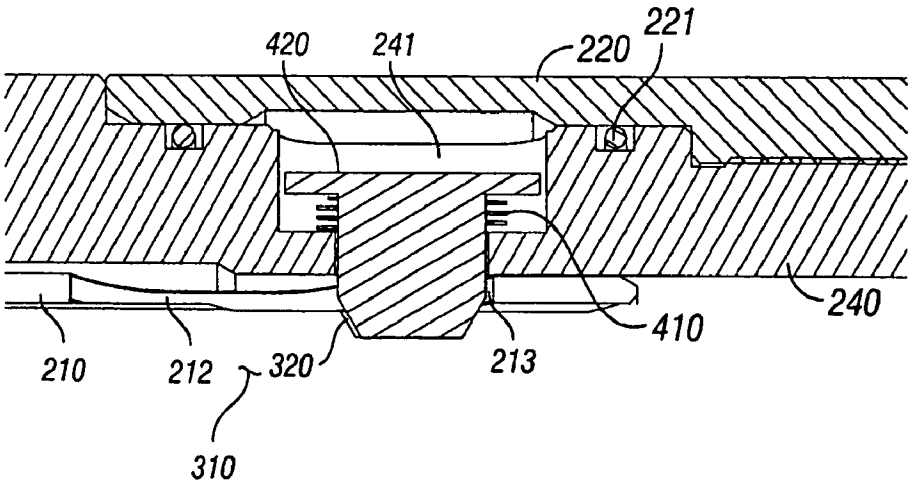
Figure 2B:
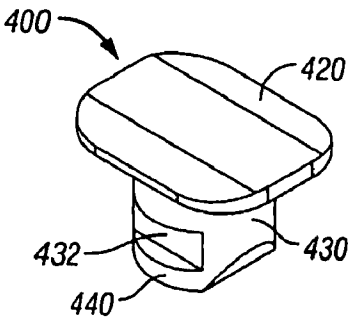
Figure 4A:
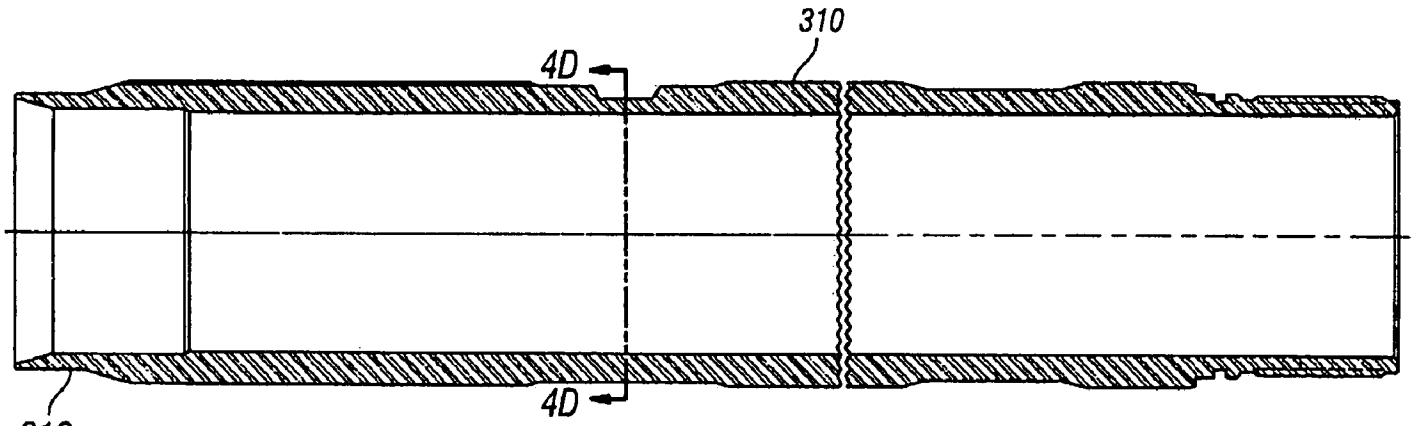
FIGS. 4A-E show a nipple of a mandrel assembly of one embodiment of the present invention in isolation, as well as detailing various aspects thereof.

FIGS. 2A-2C show the load pins 400 in various views. FIG. 2A shows the load pin 400 when in the HISR assembly 100 is in the first set or unreleased position as described hereinafter. FIG. 2B shows the load pin 400 in isolation; and FIG. 2C shows the load pin 400 of FIG. 4A in cross-section.

Referring to FIG. 2B, the load pin 400 is shown comprising a neck 430 having a head 420 on an outer end (outward from the groove 320 in the nipple 310) and a foot 440 on an inner end. Notches 432 may be provided on the neck 430 of the load pin 400. The load pin 400 may be biased outwardly by biasing means, such as via a spring 410 circumscribing the neck 430. The spring 410 may be adapted to push outwardly on the head 420 of the load pin 400, the spring 410 being compressed between the load pin head 420 and the pin housing 240.

While the HISR assembly 100 is in the initial set, unreleased configuration, the lower end of the piston 210 is adapted to circumscribe an upper end 312 of the nipple 310 of the mandrel assembly 300. As shown in FIG. 1, the mandrel assembly 300 is connected to the overshot assembly 200 by a load pin 400 resting in a groove 320 of the nipple 310. The load pin 400 is adapted to be selectively moved from a first position resting in the groove 320 in the nipple 310 to a second position outwardly from the groove in the nipple 310. Initially, the load pin 400 is adapted to lock the mandrel assembly 300 axially with respect to the overshot assembly 200.

For instance, as shown in FIG. 1, the load pin 400 rests in the groove 320 provided in the nipple 310. In this configuration, the load pin 400. passes through the recess 213 in the opening 212 of the piston 210 to selectively secure the load pin 400 in the groove 320. The notch 432 of the load pin 400 is adapted to mate with the recess 213 of the piston 210 to retain the load pin 400 in an innermost first position. The foot 440, being wider than the notch 432, which engages the recess 213 of the opening 212 in the piston 210, thus provides means for retaining the load pin 400 in its innermost first position.

As described hereinafter, once the HISR assembly 100 is activated (i.e. after shear pins 218 are sheared), the piston 210 may be moved downwardly with respect to the rest of the overshot assembly 200 and with respect to the nipple 310. As the piston 210 moves downwardly with respect to the nipple 310, the foot 440 is adapted to move from the recess 213 of the opening 212 of the piston 210 into the wider section of the opening 212 of the piston 212. In this configuration, because the opening 212 is larger than the foot 440 of the load pin 400, the load pin 400 is no longer restrained; the spring 410 pushes the load pin 400 outwardly into the void 241 in the pin housing 240. Thus, the load pin 400 is moved to its second or outer position.

It is noted that when in the HISR assembly 100 is first run downhole init unreleased configuration, the overall length of the HISR assembly remains at least substantially constant. Thus, initially, the HISR assembly is not adapted to compensate for changes in the length of the tubing or production string above or below the HISR assembly 100. However, once activated, released or unset, as described hereinafter, the length of the HISR assembly 100 may change and is therefore adapted to compensate for changes in the length of the tubing or production string, thereby reducing the stresses therein and providing a spacing mechanism therefor.

Figure 4D:
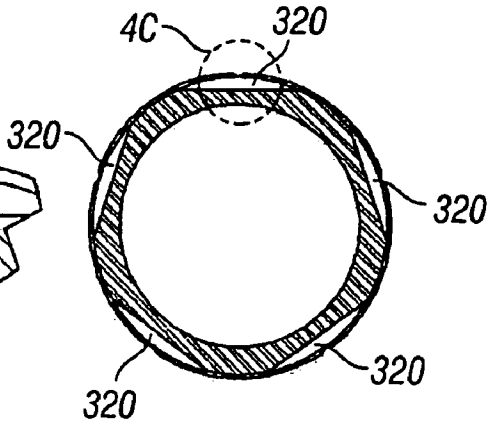
Figure 4C:
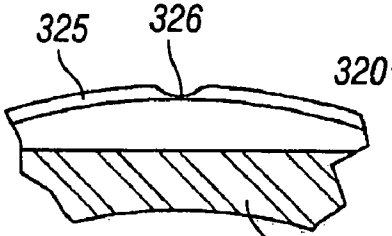
Figure 4E:
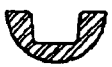
Figure 4B:
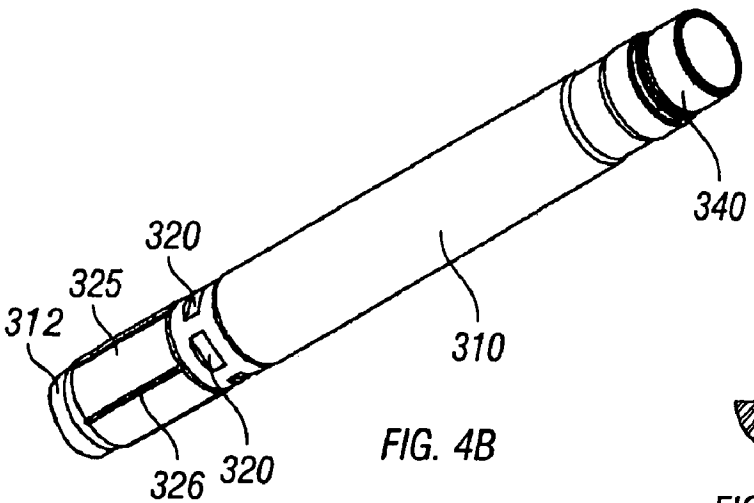

FIGS. 4A-E shown the nipple 310 of the mandrel assembly 300 in cross section (FIG. 4A) and isolation (FIG. 4B), as well as showing other aspects in FIGS. 4C-E. As show in FIG. 4B, a plurality of recesses such as grooves 320 may extend on the periphery of the nipple 310. The cross-section in FIG. 4B shows grooves 320 comprising five slots or flats. As more thoroughly described herein, when the HISR assembly 100 is in the initial, set, unreleased configuration, each of the grooves 320 in the nipple 310 are adapted to receive a foot 440 of the load pin 410, the load pin 400 being selectively secured within the groove 320 by the notches 432 of the load pin 400 associating with the recess 213 in the opening 212 of the piston 210. Of course, any number of grooves 310 in the nipple 310 may be provided.

Nipple 310 may also be provided with O-ring grooves to accommodate O-rings. Further, in some embodiments, the nipple 310 may have an upper end 325, which may include a plurality of longitudinal indentations 326 as shown in FIGS. 4B and 4D. These indentions 326 are used to provide fluid communication along the nipple 310 to prevent pressure lock.

The mandrel assembly 300 may include the nipple 310 functionally associated with at least one stinger. As shown in FIG. 1, the lower or downhole end of the nipple 310 may comprise a threaded connection 340 adapted to connect to at least one stinger being run downhole. For instance, the stinger may comprise a polished stinger 350 having a polished outer diameter. Such polished stingers may be provided in ten foot lengths or any length specified for a given job. Any number of polished stingers 350 may be utilized with the HISR assembly 100. For instance, if three polished stingers 350 are serially connected, then approximately thirty feet of linear, axial travel of the HISR assembly 100 may be provided. An overshot stop 360 may be provided at the lower most end of the lower stinger 350.

Located between the mandrel assembly 300 and the overshot assembly 200 are a plurality of internal molded seals 290. The internal molded seals 290 may comprise inverted molded seals. Once the HISR assembly 100 has been fully actuated, the mandrel assembly 300 is adapted to move relative to the overshot assembly 200. However, fluid communication is substantially prevented radially through the HISR assembly 100. That is, the seals 290 act to prevent fluid communication between the ID of the HISR assembly 100 and the annulus (between the tool and the casing). For instance, the internal molded seals 290 sliding along the polished outer diameter of the stinger 350 provides a seal to prevent fluid communication from inside the tubing/nipple 310 through the any component of the overshot assembly 200.

While not shown in the Figures, it is noted that the nipple 310 for each of the mandrel assemblies 300 described above could comprise an inner diameter on an uphole end 312, e.g., having a profile adapted to accommodate a given commercially-available nipple profile. For instance, the ID of the nipple 310 could be provided to complement a plug. Thus, the inner diameter of the nipple 310 may be selectively plugged as desired.

Operation of HISR Assembly

Operation of the embodiment of the HISR assembly 100 of FIG. 1 will now be described. Description of additional components (shearable anchor latch 500, a seal mandrel, and indexing mule shoe 600) of the HISR system will be detailed hereinafter.

Stage 1: HISR Assembly Locked

As described above, the HISR assembly 100 is run downhole during a first stage in which the HISR assembly 100 may be considered set, unreleased, or locked. In stage 1, the shear pins 218 have not been sheared, so axial movement between the piston 210 and the rest of the overshot assembly 200 is precluded. Further, each load pin 400 is secured in its innermost position contacting the groove 320 in the nipple 310. The load pins 400 are secured in the grooves 320 as the notches 432 in the neck 430 of the load pin 430 contacts the recess 213 in of the opening 212 of the piston 210. In stage 1, the HISR assembly 100 has an initial length L1. After running the tubing string 1 and HISR assembly 100 downhole—and once any component downhole of the HISR assembly 100 are run and set downhole—the HISR assembly 100 may be selectively moved to stage 2.

Stage 2: Release of load pins 400

When it is desired to activate the HISR assembly 100, hydraulic pressure is increased by applying pressure to create a differential pressure. Alternatively, the nipple 310 may be plugged and pressure applied, thereby protecting downhole components from the applied pressure. Increasing the hydraulic pressure of the fluid near the upper end of the piston 210 applies a downward force on the piston 210. Once the downward force reaches a predetermined value, e.g. 30,000 lbs. (which corresponds to a 2-3000 p.s.i. increase in hydraulic pressure), the shear pins 218 shear. Backup mechanical activation, as opposed to hydraulic activation, is also possible in some embodiments, as described hereinafter.

With shear pins 218 sheared, the increased hydraulic pressure drives the piston 210 downwardly with respect to the rest of the overshot assembly 200, the nipple 310 and the load pins 400. The piston 210 moves downwardly within the upper outer sleeve 215 such that the gap 229 is reduced in size. The piston 210 continues its downward movement, forcing downhole fluid such as brine out of gap 229 via port the 230. The piston 210 continues its downward movement until the inner shoulder 211 on the piston 210 contacts the pin housing 240. At this point, the lock ring 280 on the upper end of the piston 210 also is adapted to contact wickers 270 on the piston 210 of the overshot assembly 200.

The downward movement of the piston 210 also acts to move the load pin 400 from the recess 213 (which operates to keep each load pin 400 from extending outwardly) of the piston 210 to the larger area in the opening 212 of the piston 210. With the foot 440 of load pin no longer restrained by the recess 213 of the piston opening 212, the springs 410 operate to force the lock pins 400 from the grooves 320 in the nipple 310 radially outwardly into the void 241 below the seal cap 220 of the overshot assembly 200. In this way, the overshot assembly 200 is released from the mandrel assembly 300.

The piston 210 may also compose a shoulder having a larger inner diameter 260 to provide a backup mechanical activation system. To mechanically (as opposed to hydraulically) actuate the system, a shifting tool with collet may be lowered from surface to contact the shoulder 260 of the piston 210. Upon the application of downward mechanical force, the HISR assembly 100 may be unset by mechanical means, as opposed to hydraulic means. The operation of the tool is otherwise similar to the operation described above.

Stage 3: Relative Movement between the Mandrel Assembly and the Overshot Assembly With the load pins 400 no longer secured within the groove 320 of the nipple 310, the overshot assembly 200 (e.g. upper outer sleeve 215, pin housing 240, seal cap 220, lower overshot outer sleeve 250) is fee to move axially with respect to nipple 310 Thus, the overshot assembly 200 is free to move axially with respect to the mandrel assembly 300. That is, overshot assembly 200 may move axially relative to the mandrel assembly 300.

As the overshot assembly 200 moves relative to the nipple 310 and polished stingers 350, the internal seals 290 prevent fluid from escaping from within the mandrel assembly (e.g. nipple 310 and stingers 350) radially through the overshot assembly 200. The polished surface of the stingers 350 of some embodiments of the present invention facilitate the sealing action of the molded seals 290.

Thus, once activated and the load pins no longer connecting the overshot assembly 200 and the mandrel assembly 300, the HISR assembly 100 allows relative axial movement between the mandrel assembly 300 (e.g. the nipple 310 and stingers 350 in some embodiments) and the overshot assembly 200. In this section position, the overall length of the HISR assembly 100 is decreased from the original length L1. As such, the HISR assembly 100 fulfills the space-out function as desired. Depending on the number of polished stingers 350 being utilized, HISR assembly 100 may provide as many feet of spacing out as necessary. Typical applications may include the use of three polished stingers 350 providing thirty feet of spacing out. Thus, when the production tubing 10 contracts (e.g. when not in production), the HISR assembly 100 may expand, thus reducing the tensile stresses on the tubing 1, 10, both above and below the HISR assembly 100. When the production tubing 10 expands (such as during production), the HISR assembly 100 reduces in overall length to accommodate the increased length in the working tubing 1 and production tubing 10. The HISR assembly 100 thereby acts to reduce compressive stresses on the tubing 1, 10.

In this way, as the lengths of the tubing string either above or below (or both) expand or contact, the HISR assembly 100 may change in length to compensate, thus reducing the stress in the tubing string.

As stated above, with the HISR assembly 100 in the first (unreleased or set) stage, the overshot assembly 200 and mandrel assembly 300 are functionally associated such that axial movement therebetween is precluded. However, due to the relative strength of the load pins 400 and the configurations described herein, the HISR assembly 100 is precluded from accidental activation of the tool, unlike prior art systems which utilize shear pins activation. These prior art shear pins are prone to shearing, and thus fully activating the spacing assembly, when component of the downhole tool contact an obstruction downhole. Thus, the use of relatively-strong load pins 400 in conjunction with the components described above act to prevent premature activation of the tool.

Further, rotation of entire system is possible. In some situations, it may be desirable to rotate the HISR assembly 100. For example, if the tool contacted un-expected debris downhole, it may be desirable to rotate the downhole HISR assembly . 100 to try to obtain its release. As the HISR assembly 100 described herein is robust and utilizes the load pin 400 connection instead of a threaded connection, the entire HISR assembly 100 may be rotated clockwise in an attempt to free the string.

As stated above, the nipple 310 for each of the mandrel assemblies described above could comprise an inner diameter having a profile adapted to accommodate a given commercially-available nipple profile. For instance, the ID of the nipple could be provided to complement a nipple for a downhole plug. Thus, in operation, the plug may be lowered into the wellbore via a wire line until the plug mates with the ID of the nipple 310. Once the plug is set within the ID of the nipple 310 and the wire line raised to surface, the tubing string above the HISR assembly may be raised to surface along with the overshot assembly 200 of the HISR assembly 100, leaving the mandrel assembly 300 such as the nipple 310 (now containing the plug) and the polished stingers 350 on the tubing string down hole. In this way, components on the string above the HISR assembly 100 (such as motors, pumps, etc) may be removed to surface and repaired, etc., while providing a plug to cease production from the wellbore. Once the component is repaired or replaced, the overshot assembly 200 of the HISR assembly and the tubing string may be lowered from surface, until the overshot assembly 200 again envelops the mandrel assembly 300 such as the nipple 310 on the stingers. The mule shoe 299 on the overshot assembly 200 is adapted to facilitate the proper orientation of the overshot assembly 200 with the mandrel assembly 300. The plug may then be removed and production may resume.

Thus, the disclosed system provides a versatile assembly which may allow for repair of components uphole of the HISR assembly 100.

Additional Components

Figure 5A:
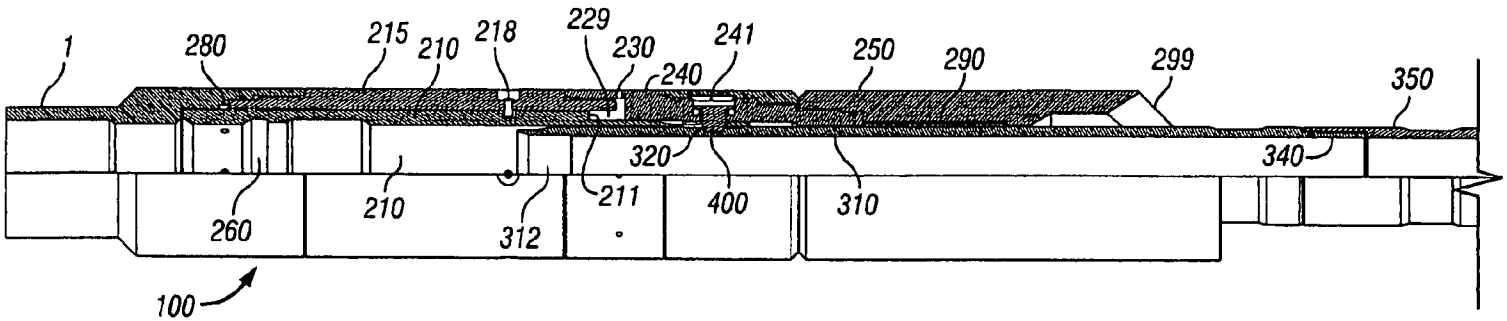
FIGS. 5A-5C show an HSIR system including an embodiment of an HISR assembly functionally associated with a shearable anchor latch assembly of an embodiment of the present invention, which is functionally associated with an indexing mule shoe for insertion into a packer (not shown).
Figure 5B:
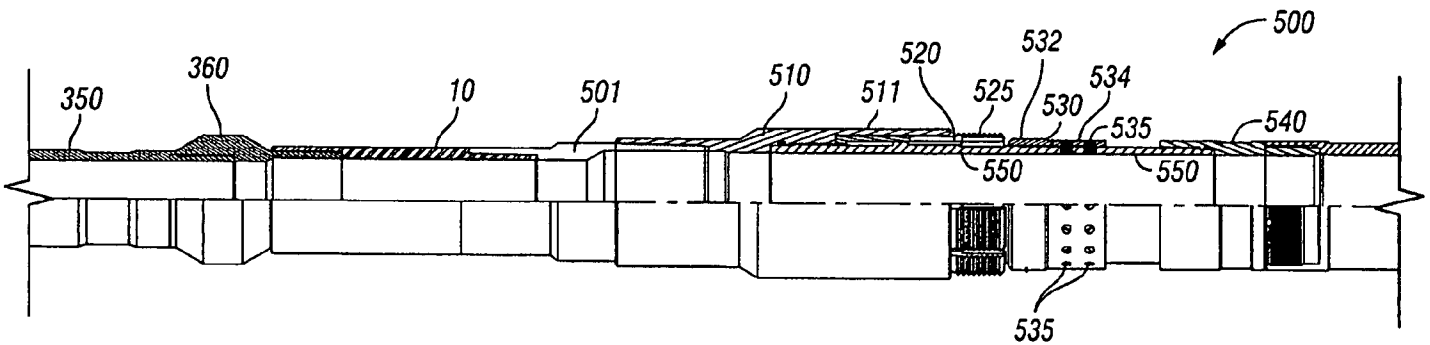
Figure 5C:
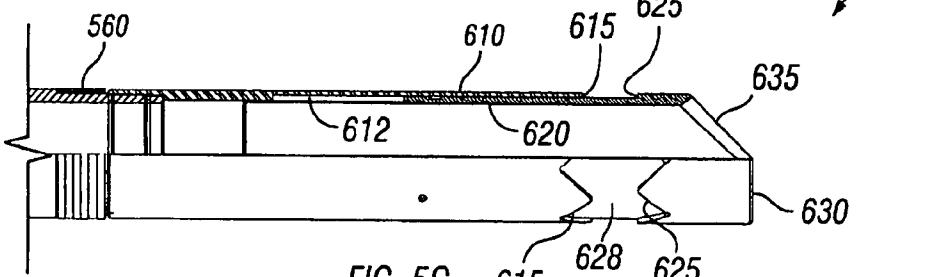

FIGS. 5A-C show additional components of a downhole system including the HISR assembly 100 described above. Below the polished stingers 350 of the mandrel assembly 300 are a plurality of production tubing segments 10. The number of segments 10 depends on the particular operation, but may extend for thousands of feet, e.g. Attached downhole of the segments 10 is a shearable anchor latch 500 adapted to selectively engage in a packer and to selectively connect to lower seal string having seal 560 and an indexing mule shoe 600.

The shearable anchor latch 500 in the embodiment shown in FIG. 5C includes a crossover 501 for attachment to the tubing 10. The crossover 501 may threadedly engage a top sub 510. The top sub 510 includes a portion having an ID on its lower end 511, which is adapted to circumscribe a latch 520. The latch 520 includes flexible collet fingers 525 adapted to engage a packer (not shown) downhole. The flexible collet fingers 525 may include wickers to facilitate gripping engagement with the downhole tool, such as a packer (not shown).

On the lower end of the central mandrel 550 is a shear ring 530, The shear ring 530 includes an upper section 532 or collar adapted to be circumscribed by the collet fingers 525, thus driving the collet fingers 525 radially outwardly to prevent premature release from the packer as described hereinafter. The shear ring 530 may also comprise an attachment section 534 in which the shear ring 530 is attached to the mandrel 550 by a plurality of shear screws 535. As would be realized by one of ordinary skill in the art having the benefit of this disclosure, the number, size, and strength of such shear screws 535 may be varied depending on the predetermined shear force at which pins are desired to be sheared. For instance, in some applications, the number, size, and type of shear screws 535 are selected such that to shear at 90,000 lbs.

The lower end of the mandrel 550 may be attached to a bottom sub 540. As shown in FIG. 5C, the bottom sub 540 may be connected to seal units having external seals 560, which are adapted to sealingly engage the inner diameter of the packer when set as described hereinafter.

Operation of the shearable anchor latch 600 is similar to a pop lock or anchor lock known in the art; however, unlike some prior art mechanisms, the shearable anchor latch 600 is adapted to shear away from other downhole components to which the shearable anchor latch 600 is connected upon the application of a predetermined upward force.

Prior art pop locks generally are not significantly robust for the application described herein; however, anchor locks cannot be selectively removed without rotation, which is not desirable. The present shear anchor latch provides a robust latching mechanism that can be selectively decoupled downhole without requiring rotation.

Indexing Mule Shoe 600

Located at the bottom of the HISR system described herein is an indexing mule shoe 600. That is, the indexing mule shoe 600 is the lowermost component of the system when running downhole.

The indexing mule shoe 600 is shown in FIG. 5C as comprising an outer sleeve 610 circumscribing an inner sleeve 620. A spring (not shown) biases the outer sleeve and inner sleeve 620 away from one another as shown in FIG. 5C, thus creating a gap 612. The outer sleeve 610 is provided with a lower end having tapers or a sloped edge or surface 615. Similarly, the inner sleeve 620 is provided with a section having tapers or a sloped edge or surface 525 adapted to selectively mate with the surface 615 on the outer sleeve 610. A cavity 628 is shown between the sloped surfaces 615 of the outer sleeve 610 and the complementary sloped surface 625 of the inner sleeve 620. The lower end of the inner sleeve 620 has a blunt portion 630 and an angled portion 640. It is noted that the inner sleeve may rotate with respect to the outer sleeve when the sloped surfaces 615, 625 are not mating.

Operation of the indexing mule shoe 600 of the HISR system follows. The tubing string (and the various components of the HISR system) is lowered from surface into a borehole until the indexing mule shoe 600 contacts a packer assembly downhole. It is desirable that the angled portion 635 of the end of the indexing mule shoe contact the packer downhole. That is, if the blunt end 630 contacts the packer, then it is desirable to rotate the mule shoe 600 such that the angled portion 635 contacts the packer properly. The alignment is especially problematic in deviated or horizontal wells.

Thus, if the indexing muleshoe is not correctly aligned with the packer, then the application of downward force will compress the outer sleeve 610 against the inner sleeve 620. The inner sleeve 620 is precluded from further downhole movement via contact with the packer. As the outer sleeve 610 moves downwardly, the gap 612 reduces in size, and the sloped surface 615 of the outer sleeve 610 contacts the complementary sloped surfaced 625 of the inner sleeve 620. The mating of the sloped surfaces 615, 625 acts to rotate the inner sleeve 620 with respect to the outer sleeve 610, thus indexing the muleshoe. In this way, the muleshoe 600 provides the desired rotation of the end 630 of the muleshoe so that the muleshoe may be properly aligned with the packer, while not requiring rotation of other components downhole and not requiring the rotation of the entire HISR system.

The tubing string is pulled upwardly, thus re-created the gap 612, the spring once again biasing the outer sleeve 610 from the inner sleeve 620. The tubing sting is again lowered until the muleshoe contacts the packer. These steps are repeated until the muleshoe 600 is properly aligned with the packer; i.e. until the angled portion 635 of the muleshoe 600 contacts the packer. Once the angled portion 635 of the muleshoe 600 contacts the packer, the muleshoe may then be inserted into the packer and run further downhole.

Operation of the Shearable Anchor Latch

Once the indexing mule shoe 600 as entered the packer downhole, the tubing string is lowered further. The external seals 560 contact the packer and the production string below the packer, thus facilitating the seal between the HISR system and the packer. The system is lowered until the collet fingers 525 contact the inner diameter of the packer downhole. The collet fingers 525 initially engage the packer. As a test, a slight upward force on the tubing string pulls the mandrel 550 upwardly with respect to the latch 520. This upward movement of the mandrel 550 also causes the upper section 532 of the shear ring 530 to move up and under the collet fingers 525, thus driving the collet fingers radially outwardly to engage the packer further. Thus, the collet fingers 525 (via wickers if used) are adapted to engage the inner diameter of the packer.

Thus, the shearable anchor latch 600 is adapted to selectively connect the HISR system to the packer downhole. However, if it becomes necessary to remove tubing string and HISR system from downhole for any reason, e.g. if a component encounters debris downhole, an upward force will shear the latch and free the HISR assembly 100 as follows.

Application of additional upward force exerts a downward force on the upper section 532 of the shear ring 530, the latch 520 in contact with the upper section 532. Once the upward force reaches a predetermined value, e.g. 90,000 lbs., the shear screws 535 shear, allowing the tubing string including the cross over 501 and top sub 510 to be pulled to surface, while the shear ring 530, mandrel 550, and latch 520 are allowed to fall downhole. Any components on the string below the shear ring also fall downhole.

Thus, the shearable anchor latch 600 provides a secure connection to the packer downhole, while allowing selective disengagement should the string and the rest of the HISR system need to be removed.

Utilizing the above HISR system described above allows all three tools to be run on a single trip. The HISR system may be also be utilized where rotation on the job is precluded. For instance, when operating in a severely deviated or a horizontal well, the torque required to rotate the string may exceed the thread strength of the tubing strings. Further, when installing permanent downhole gauges or intelligent systems, which include hydraulic lines, fiber optic lines, or electrical lines, rotation is precluded to prevent entanglement. Finally, the HISR system described above is especially well-suited for use with submersible pumps. Regarding the submersible pumps, the system is well-suited due to the fact that the pumps require electric lines that cannot be rotated during installation and to the fact that the pumps need periodically maintenance and with the HISR, we can detach the HISR, pull out of the hole with the pump, change or repair and go back and sting on the HISR mandrel again.

Although various embodiments have .been shown and described, the invention is not so limited and will be understood to include all such modifications and variations as would be apparent to one skilled in the art.

The following table lists the description and the references designators as may be utilized herein and in the attached drawings.

| Reference Designator | Component |
|---|---|
| 1 | pipe or tubing string to surface/work string |
| 10 | production tubing segments |
| 100 | HISR assembly |
| 200 | overshot assembly |
| 210 | piston |
| 211 | inner shoulder on piston |
| 212 | piston opening |
| 213 | recess of piston opening |
| 215 | upper outer sleeve of overshot assembly |
| 218 | shear pin |
| 220 | seal cap |
| 221 | o-rings |
| 229 | gap |
| 230 | port |
| 240 | pin housing |
| 241 | void |
| 250 | lower overshot sleeve |
| 260 | shoulder for mechanical activation |
| 270 | wickers |
| 271 | groove for o-ring |
| 280 | lock ring |
| 290 | molded seals |
| 299 | mule shoe on lower end of overshot assembly200 |
| 300 | mandrel assembly |
| 310 | nipple |
| 311 | inner diameter of nipple 310 |
| 312 | upper end of nipple 310 |
| 320 | groove or slot in nipple 310 |
| 325 | upper portion |
| 326 | longitudinal indentations |
| 330 | o-ring groove |
| 340 | threaded connection |
| 350 | polished stinger |
| 360 | overshot stop |
| 400 | load pin |
| 410 | spring |
| 420 | head |
| 430 | neck |
| 432 | notch in neck |
| 440 | foot |
| 500 | shearable anchor latch |

-continued

| Reference Designator | Component |
|---|---|
| 501 | crossover |
| 510 | top subassembly |
| 511 | outer diameter of top sub |
| 520 | latch |
| 522 | protrusion |
| 525 | collet fingers |
| 530 | shear ring |
| 532 | upper section of shear ring |
| 534 | attachment section of shear ring |
| 535 | shear screws |
| 540 | bottom subassembly |
| 550 | mandrel |
| 560 | seal on lower seal string |
| 600 | indexing mule shoe |
| 610 | outer sleeve |
| 612 | gap |
| 615 | sloped surface on lower end of outer sleeve |
| 620 | inner sleeve |
| 625 | complementary sloped surface of inner sleeve |
| 628 | cavity |
| 630 | end (partially blunt) |
| 635 | angled surface of end |

What is claimed is:

1. A tubing string spacing mechanism comprising:

an overshot assembly connected to an upper portion of a tubing string, the overshot assembly comprising an upper sleeve, a lower sleeve, a piston, and a pin housing, wherein the piston is selectively connectable to the upper sleeve, the upper sleeve is connectable to an upper portion of the pin housing, and the lower sleeve is sealingly connectable to a lower portion of the pin housing;

a mandrel assembly connected to a lower portion of the tubing string, the mandrel assembly comprising a nipple connectable to at least one stinger; and at least one load pin having a first position and a second position, wherein in the first position the load pin selectively connects the overshot assembly to the mandrel assembly.

2. The spacing mechanism of claim 1, further comprising a gap between the piston and the pin housing and a fluid port through the pin housing, wherein the fluid port is located along the gap and allows fluid communication with the gap.

3. The spacing mechanism of claim 1, wherein the piston is selectively connectable to the upper sleeve by at least one sheer pin.

4. The spacing mechanism of claim 3, wherein the removal of the at least one sheer pin allows movement of the piston with respect to the upper sleeve.

5. The spacing mechanism of claim 1, the piston includes wickers that mate with a lock ring connected to the upper sleeve that circumscribes the piston.

6. The spacing mechanism of claim 1, wherein the piston is selectively connectable to the upper sleeve by at least one sheer pin and the piston further comprises at least one opening.

7. The spacing mechanism of claim 6, wherein the at least one opening a recess.

8. The spacing mechanism of claim 7, wherein the recess of the at least one opening is adapted to secure the at least one load pin in the first position.

9. The spacing mechanism of claim 8, wherein the removal of the at least one sheer pin allows movement of the piston with respect to the upper sleeve.

10. The spacing mechanism of claim 9, wherein the movement of the piston with respect to the upper sleeve provides movement of the at least one load pin to the second position allowing movement of the overshot assembly with respect to the mandrel assembly.

11. A spacing mechanism means for use in a tubing string, comprising:

an overshot assembly, the overshot assembly comprising an upper sleeve, a lower sleeve, a piston, and a pin housing;

means for connecting the upper sleeve to the pin housing;

means for selectively connecting the piston to the upper sleeve;

means for connecting the lower sleeve to the pin housing;

a mandrel assembly, the a nipple and at least one stinger;

means for connecting the nipple to the at least one stinger;

means for selectively connects the overshot assembly to the mandrel assembly; and means for providing movement of the overshot assembly with respect to the mandrel assembly.

12. A method of providing a mechanism to accommodate a change in the length of a tubing string comprising:

connecting an overshot assembly to an upper portion of a tubing string, wherein the overshot assembly includes an upper sleeve, a lower sleeve, a piston, and a pin housing;

wherein at least one connector selector connects the piston to the upper sleeve;

connecting a mandrel assembly to a lower portion of the tubing string, wherein the mandrel assembly includes a nipple and at least one stinger;

connecting the mandrel assembly to the overshot assembly by a load pin located in a first position;

removing the at least one connector, wherein the piston moves downward with respect to the upper sleeve and moves the load pin to a second position;

releasing the connection between the mandrel assembly and the overshot assembly;

moving the overshot assembly with respect to the mandrel assembly, wherein the movement is due to a change in the length of the overall tubing string.

13. A downhole apparatus comprising:

a tubing string spacing mechanism having an overshot assembly connected to an upper portion of a tubing string, the overshot assembly comprising an upper sleeve, a lower sleeve, a piston, and a pin housing, wherein the piston is selectively connectable to the upper sleeve, the upper sleeve is connectable to an upper portion of the pin housing, and the lower sleeve is sealingly connectable to a lower portion of the pin housing;

a mandrel assembly connected to a lower portion of the tubing string, the mandrel assembly comprising a nipple connectable to at least one stinger; and at least one load pin having a first position and a second position, wherein in the first position the load pin selectively connects the overshot assembly to the mandrel assembly; and a downhole alignment apparatus having:

an outer sleeve having an upper end and a lower end, the lower end of the outer sleeve includes at least one tapered surface;

an inner sleeve having an upper end and a lower end, wherein the inner sleeve includes at least one tapered surface;

wherein the outer sleeve circumscribes the inner sleeve;

wherein the outer sleeve and the inner sleeve are biased such that a cavity initially exists between the at least one tapered surface of the inner sleeve and the at least one tapered surface of the outer sleeve;

wherein upon the application of a force the inner sleeve may rotate with respect to the outer sleeve and the outer sleeve may move towards the inner sleeve to reduce the cavity; and wherein the tapered surface of the inner sleeve is adapted to mate with the tapered surface of the lower end of the outer sleeve when the at least one tapered surface of the inner sleeve is aligned with the at least one tapered surface of the outer sleeve.

14. The downhole apparatus of claim 13, wherein the lower end of the inner sleeve of the alignment apparatus is adapted to align with a downhole component.

15. The downhole apparatus of claim 14, wherein the lower end of the inner sleeve includes a blunt portion and an angled portion.

16. A downhole apparatus comprising:

a tubing string spacing mechanism having an overshot assembly connected to an upper portion of a tubing string, the overshot assembly comprising an upper sleeve, a lower sleeve, a piston, and a pin housing, wherein the piston is selectively connectable to the upper sleeve, the upper sleeve is connectable to an upper portion of the pin housing, and the lower sleeve is sealingly connectable to a lower portion of the pin housing;

a mandrel assembly connected to a lower portion of the tubing string, the mandrel assembly comprising a nipple connectable to at least one stinger; and at least one load pin having a first position and a second position, wherein in the first position the load pin selectively connects the overshot assembly to the mandrel assembly; and a latch anchor system, the latch anchor system having:

a crossover for attachment to the tubing string below the tubing string spacing mechanism, the crossover threadedly engaging a top sub;

a latch, an upper portion of the latch circumscribed by the sub and a lower portion of the latch including collet fingers, wherein the collet fingers are adapted to engage a packer;

a mandrel, wherein the latch is attached to the exterior of the mandrel;

a shear ring, the shear ring circumscribing the mandrel below the latch, wherein the shear ring is adapted to drive the collet fingers radially outward due to upward movement of the mandrel; and at least one shear screw, wherein the shear screw selectively connects the shear ring to the mandrel.

17. The downhole apparatus of claim 16, wherein the application of a force shears the at least one shear screw releasing the crossover from the latch and the mandrel.

18. A tubing string connection system comprising:

a spacing mechanism, wherein the spacing mechanism adjusts to the expansion and contraction of a tubing string, the spacing mechanism further comprising an overshot assembly connected to an upper portion of the tubing string, the overshot assembly comprising an upper sleeve, a lower sleeve, a piston, and a pin housing, wherein the piston is selectively connectable to the upper sleeve, the upper sleeve is connectable to an upper portion of the pin housing, and the lower sleeve is sealingly connectable to a lower portion of the pin housing;

a mandrel assembly connected to a lower portion of the tubing string, the mandrel assembly comprising a nipple connectable to at least one stinger; and at least one load pin having a first position and a second position, wherein in the first position the load pin selectively connects the overshot assembly to the mandrel assembly and wherein the motion of the piston allows the load pin to move to the second position releasing the mandrel from the overshot assembly;

an alignment apparatus, wherein the alignment apparatus may rotate independent of the tubing string to provide proper alignment with a downhole component; and a shearable anchor latch, wherein the shearable anchor latch is adapted to engage a packer and provides the selective release of a portion of the tubing string without rotation of the tubing string.

19. The downhole string connection system of claim 18, wherein the alignment apparatus comprises:

an outer sleeve having an upper end and a lower end, the lower end of the outer sleeve includes at least one tapered surface;

an inner sleeve having an upper end and a lower end, wherein the inner sleeve includes at least one tapered surface;

wherein the outer sleeve circumscribes the inner sleeve;

wherein the outer sleeve and the inner sleeve are biased such that a cavity initially exists between the at least one tapered surface of the inner sleeve and the at least one tapered surface of the outer sleeve;

wherein upon the application of a force the inner sleeve may rotate with respect to the outer sleeve and the outer sleeve may move towards the inner sleeve to reduce the cavity; and wherein the tapered surface of the inner sleeve is adapted to mate with the tapered surface of the lower end of the outer sleeve when the at least one tapered surface of the inner sleeve is aligned with the at least one tapered surface of the outer sleeve.

20. The downhole string connection system of claim 18, wherein the shearable anchor latch comprises:

a crossover attached for attachment to the tubing string;

a latch, an upper portion of the latch circumscribed by the crossover and a lower portion of the latch including collet fingers, wherein the collet fingers are adapted to engage a packer;

a mandrel, wherein the latch is attached to the exterior of the mandrel;

a shear ring, the shear ring circumscribing the mandrel below the latch, wherein the shear ring is adapted to drive the collet fingers radially outward due to upward movement of the mandrel; and at least one shear screw, wherein the shear screw selectively connects the shear ring to the mandrel.

21. A tubing string connection system comprising:

a spacing mechanism, wherein the spacing mechanism adjusts to the expansion and contraction of a tubing string;

an alignment apparatus, wherein the alignment apparatus may rotate independent of the tubing string to provide proper alignment with a downhole component, the alignment apparatus further comprising an outer sleeve having an upper end and a lower end, the lower end of the outer sleeve includes at least one tapered surface;

an inner sleeve having an upper end and a lower end, wherein the inner sleeve includes at least one tapered surface;

wherein the outer sleeve circumscribes the inner sleeve;

wherein the outer sleeve and inner sleeve are biased such that a cavity initially exists between the at least one tapered surface of the inner sleeve and the at least one tapered surface of the outer sleeve;

wherein upon the application of a force the inner sleeve may rotate with respect to the outer sleeve and the outer sleeve may move towards the inner sleeve to reduce the cavity; and wherein the tapered surface of the inner sleeve is adapted to mate with the tapered surface of the lower end of the outer sleeve when the at least one tapered surface of the inner sleeve is aligned with the at least one tapered surface of the outer sleeve; and a shearable anchor latch, wherein the shearable anchor latch is adapted to engage a packer and provides the selective release of a portion of the tubing string without rotation of the tubing string.

* * * * *